US009803454B2

(12) United States Patent
Wetzel, Jr. et al.

(10) Patent No.: US 9,803,454 B2
(45) Date of Patent: Oct. 31, 2017

(54) SAND CONTROL DEVICE AND METHODS FOR IDENTIFYING EROSION

(71) Applicants: Rodney Joseph Wetzel, Jr., Magnolia, TX (US); Michael James Fuller, Cypress, TX (US)

(72) Inventors: Rodney Joseph Wetzel, Jr., Magnolia, TX (US); Michael James Fuller, Cypress, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 419 days.

(21) Appl. No.: 14/567,787

(22) Filed: Dec. 11, 2014

(65) Prior Publication Data

US 2016/0168960 A1 Jun. 16, 2016

(51) Int. Cl.
*E21B 43/08* (2006.01)
*E21B 47/10* (2012.01)

(52) U.S. Cl.
CPC ..... *E21B 43/084* (2013.01); *E21B 43/08* (2013.01); *E21B 47/1015* (2013.01)

(58) Field of Classification Search
CPC .... E21B 43/08–43/088; E21B 47/1015; E21B 49/08; E21B 47/10
USPC ..... 166/250.01, 278, 265, 266, 227–236
See application file for complete search history.

(56) References Cited

U.S. PATENT DOCUMENTS 5,823,260 A * 10/1998 McConnell ..... B01D 29/216 166/230
2012/0118564 A1* 5/2012 Gomes ..... E21B 43/08 166/250.12
2012/0229804 A1* 9/2012 Clarke ..... G01N 21/71 356/316
2015/0047830 A1* 2/2015 Morton ..... E21B 43/084 166/230

FOREIGN PATENT DOCUMENTS

JP 2016056469 A * 4/2016
WO WO 2006/004426 1/2006

* cited by examiner

*Primary Examiner* — George Gray
(74) *Attorney, Agent, or Firm* — King & Spalding LLP

(57) ABSTRACT

A sand control screen assembly includes a base pipe, a mesh layer, and a sand screen layer. The base pipe includes a tubular surface and a plurality of perforations formed in the surface. The mesh layer is disposed around the base pipe. Additionally, the mesh layer comprises a plurality of functionalized fibers, wherein one or more of the plurality of functionalized fibers break off from the mesh layer when impacted by one or more particulates. In some embodiments, a sand control screen assembly includes a screen layer with a functionalized coating.

11 Claims, 5 Drawing Sheets

SAND CONTROL DEVICE AND METHODS FOR IDENTIFYING EROSION

TECHNICAL FIELD

The present application relates to identifying and measuring erosion or erosion potential of downhole equipment. Specifically, the present application relates to a sand control device and methods for erosion detection.

BACKGROUND

Oil and/or gas are typically recovered from underground reservoirs containing such fluids. The fluids are brought to the surface via a production tubing inserted into a well formed in the reservoir. The production tubing includes one or more openings or perforations which allow the fluids to enter the production tubing from the reservoir. Because the fluids are flowing from rock formations, there may be various particulates being carried in the fluid, such as rock bits, sediments, and the like. In order to prevent these particulates from being carried into the production tubing, a sand control device is disposed over a portion of the production tubing. The sand control device acts as a screen or filter which prevents some particulates from entering the production tubing. A sand control device may include one or more screen layers of similar or different construction in order to prevent various particulates from entering the production tubing. However, some reservoirs or reservoir regions may produce particulates that are too small to be filtered out by conventional sand control devices. These particulates may impact various downhole equipment and cause erosion in the equipment. Thus, it would be beneficial to be able to measure or detect reservoirs and/or reservoir regions with high concentrations of these fine particulates.

SUMMARY

In general, in one aspect, the disclosure relates to a sand control screen assembly. The sand control screen assembly includes a base pipe, a mesh layer, and can include additional screen layers or protective cover layers. The base pipe includes a tubular surface and a plurality of perforations formed in the surface. The mesh layer is disposed around the base pipe. Additionally, the mesh layer comprises a plurality of brittle fibers of specific chemical functionality, wherein one or more of the plurality of brittle functionalized fibers break off from the mesh layer when impacted by one or more particulates. The sand screen layer is disposed around the fiber mesh layer which may have varied chemical-functionality at various locations depths along the reservoir section.

In another aspect, the disclosure can generally relate to a sand control screen assembly. The sand control screen assembly includes a screen body and a sand screen. The screen body includes a base pipe. The base pipe has a tubular surface and a plurality of perforations formed in the surface. The sand screen is disposed around the surface of the base pipe. Additionally, the sand screen, the base pipe, or both, is at least partially coated with a coating of specific chemical functionality. At least a portion of the tracer coating breaks off from the sand screen, the base pipe, or both, as coating particles when impacted by one or more particulates during production through the sand control screen assembly.

In another aspect, the disclosure can generally relate to a method of identifying erosive particulates from a reservoir. The method of identifying erosive particulates from a reservoir includes recovering a production fluid from a well through a sand control device, wherein the sand control device comprises a screen layer comprising at least a first functionalized material. The method of identifying erosive particulates from a reservoir further includes determining the presence of the first functionalized material in the recovered production fluid. The method of identifying erosive particulates in a reservoir also includes determining a concentration of the first functionalized material.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
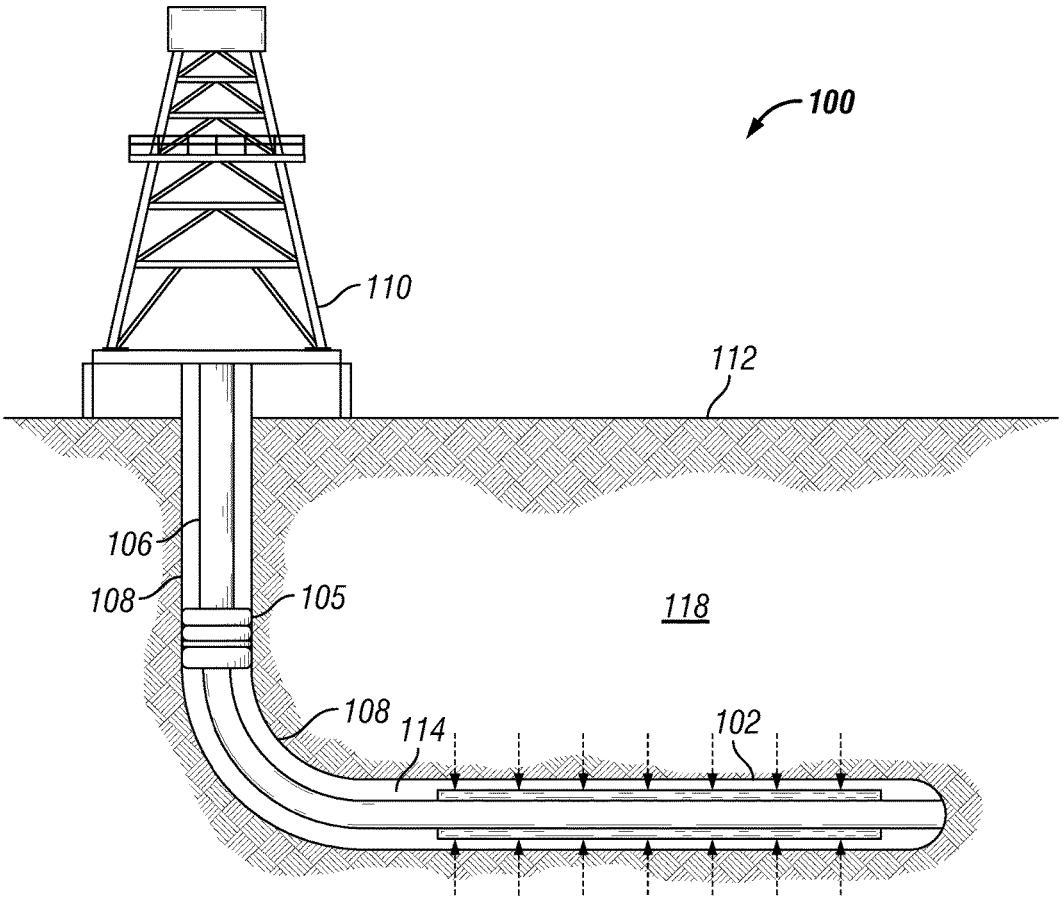
FIG. 1 illustrates a schematic diagram of a well site in which a sand control device for detecting erosion is implemented, in accordance with example embodiments of the present disclosure.

Example embodiments directed to a sand control device and methods for detecting erosion will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. The example embodiments illustrated herein include certain components that may be replaced by alternate or equivalent components in other example embodiments as will be apparent to one of ordinary skill in the art.

Referring now to the drawings, FIG. 1 illustrates a schematic diagram of a well site 100 in which a sand control device for detecting erosion 102 (hereinafter "sand control device) is implemented, in accordance with example embodiments of the present disclosure. In certain example embodiments, and as illustrated, the sand control device 102 is deployed in a horizontal wellbore 108. However, in other example embodiments, the sand control device 102 is deployed in a vertical wellbore. In certain example embodiments, the sand control device 102 is deployed in other types of wells, and not limited to use in vertical or horizontal wells. The wellbore 108 is formed in a subterranean formation 118 and coupled to a rig 110 on a surface 112 of the formation 118. The formation 118 can include one or more of a number of formation types, including but not limited to shale, limestone, sandstone, clay, sand, and salt. The surface 112 may be ground level for an on-shore application or the sea floor for an off-shore application. In certain embodiments, a subterranean formation 118 can also include one or more reservoirs in which one or more resources (e.g., oil, gas, water, steam) are located. In certain example embodiments, the wellbore 108 is cased with cement or other casing material, which is perforated to allow fluids to flow from the formation 118 into the well 108. In other example embodiments, the wellbore 108 is not cased.

A production tubing 106 is disposed downhole within the well 108. Fluids are recovered and brought to the rig 110 through the production tubing. In certain example embodiments, a production packer 105 is coupled to the production tubing 106. In certain example embodiments, the sand control device 102 is disposed around at least a portion of the production tubing 106. In certain such embodiments, production fluid flows through the sand control device 102 in order to enter the production tubing 106 and be recovered. In certain other embodiments, a hydraulic fracture with proppant may be induced within the formation 118, and production may occur both through the propped fracture and the sand control device 102. The sand control device 102 acts as a filter or screen, preventing certain particulates from entering the production tubing 106 and being brought to the surface. However, relatively small particulates, called "fines" may be capable of moving through the sand control device 102. These particulates impact different internal parts of the sand control device 102, causing erosion in the sand control device 102. The sand control device 102 helps provide an indication of the level of erosion. In order to detect the amount of erosion and/or erosion potential in a particular portion of the well 108, the sand control device 102 includes an indicator material, a portion of which is broken off when impacted by particulates and enters the recovered production stream. The material is then detected from the recovered fluid and a measure of erosion and/or erosion potential is determined from the amount of material detected.

Figure 2:
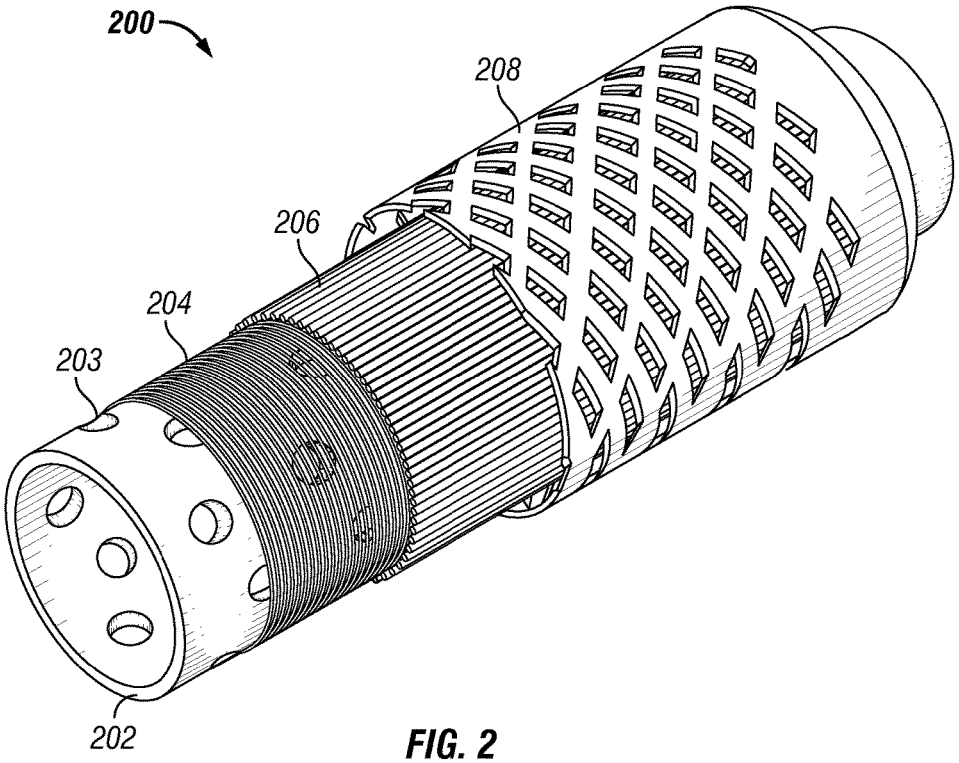
FIG. 2 illustrates a layered cut-out view of a sand control device, in accordance with example embodiments of the present disclosure.
Figure 3:
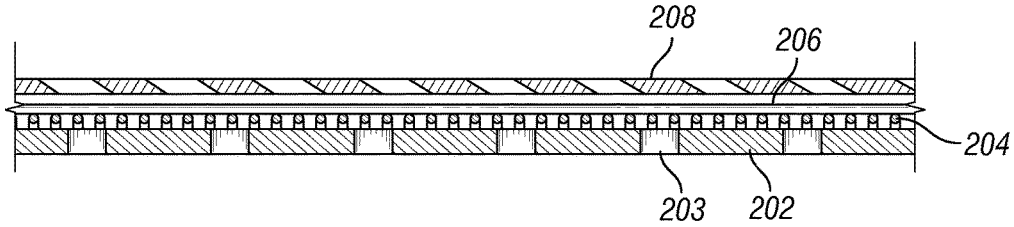
FIG. 3 illustrates a cross sectional view of the layers of the sand control device, in accordance with example embodiments of the present disclosure.

FIG. 2 illustrates a layered cut-out view of a sand control device 200, in accordance with example embodiments of the present disclosure. The sand control device 200 is one example embodiment of the sand control device 102 of FIG. 1. In certain example embodiments, the sand control device 200 has a generally tubular shape and comprises one or more layers, which include a base pipe 202, a fiber mesh 204, a screen medium 206, and an outer screen 208. In certain example embodiments, the sand control device 200 can have any number of filtering layers. FIG. 3 illustrates a cross sectional view of the aforementioned layers of the sand control device 200, in accordance with example embodiments of the present disclosure. Referring to FIGS. 2 and 3, the base pipe 202 includes a plurality of perforations 203 which allow production fluid to enter the base pipe 202 and eventually the production tubing 106. In certain example embodiments, the screen medium 206 and outer screen 208 can be any type of standard or new screen layer for preventing particulates from entering the production tubing 106. In certain example embodiments, the fiber mesh 204 disposed between the base pipe 202 and the screen medium 206. In certain example embodiments, the fiber mesh 204 is fabricated from functionalized silicate fibers. In certain example embodiments, the fiber mesh 204 has a brittle quality which enables breakage when impacted by particulates that are small enough to have traveled through the outer screen 208 and screen medium 206. When the particulates in the production fluid impact the fiber mesh 204, little bits of the fiber mesh material break off and enter the production stream and into the production tubing 106. In certain example embodiments, the fiber mesh 204 is fabricated from a material comprising borosilicate, a commercially available form of borosilicate fiber. As boron is unlikely to occur naturally within production fluid recovered from a formation 118, the detection of boron material in recovered fluid would indicate the presence of erosive particles in the well region. In certain example embodiments, the fiber mesh 204 is fabricated from a material comprising other silicate fibers, including soda lime glass, fiberglass, oxide glass, fluoride glass, aluminosilicate, phosphate glass, borate glass, and others. In certain example embodiments, silicate fibers can be readily surface-modified through treatment with functional organosilanes whose functionalities are also not naturally produced in production fluid. In certain example embodiments, the organosilanes have organic layers that are functionalized with fluoride, bromide, sulfur, phosphorous, fluorescent organic molecules, or any other functionalities whose unique presence would not otherwise occur in production fluid.

In certain example embodiments an amount of erosion or expected erosion can be estimated from the amount of silicate fibers detected in the production fluid at the surface. In certain example embodiments, the sand control device 200 can be divided into a plurality of zones, each zone corresponding to a respective reservoir region. The different zones of the sand control device 200 can have fiber mesh 204 portions fabricated with different types of silicate fibers, or silicate fibers functionalized with different derivatized-silane layers. These different materials are detectably distinct from each other such that the relative amounts of erosion or erosive potential between the plurality of zones can be measured by the relative produced amounts of zone-specific or depth-specific functionalized-compounds. Thus, the zones and respective reservoir regions with relatively higher amounts of erosive particulates can be known.

When the production fluid containing functionalized silicate fibers is recovered at the surface, the functionalized silicate fibers can be detected through several detection methods. In certain example embodiments, functionalized silicate fibers are detected through solid state measurements. In this method, the produced solids (broken bits of the glass fiber mesh 204) can be analyzed in their original form. One means of determining the presence of such materials is through the use of energy dispersive x-ray spectroscopy (EDS), which measures the relative amount of different functional atoms in a solid sample. Additionally, a scanning electron microscopy (SEM) analysis can also be performed on the sample toward visible qualification of the amount of broken fiber solid versus solids naturally produced from the reservoir (such as clays, fines, scale, and deconsolidated formation solid). In certain example embodiments, the relative amounts of various functional materials can be found through analyzing aggregate samples of produced solids.

In certain example embodiments, functionalized silicate fibers are detected through liquid state measurements. In this method, the solid materials are first treated to digest the solids and render the solid materials dissolved in a carrier fluid. In certain example embodiments, this treatment includes heating the solid materials in an organic solvent, an aqueous solution of base (high pH), an acid, or the like. After the solid materials are dissolved into a liquid, the liquid solution containing the functionalized materials can be analyzed for the presence of the functionalized materials. In certain example embodiments, inductively coupled plasma (ICP) spectroscopy, among other appropriate techniques, can be used to perform the analysis and determine the relative amount of the one or more functionality dissolved into solution from digestion of the solids.

Figure 4:
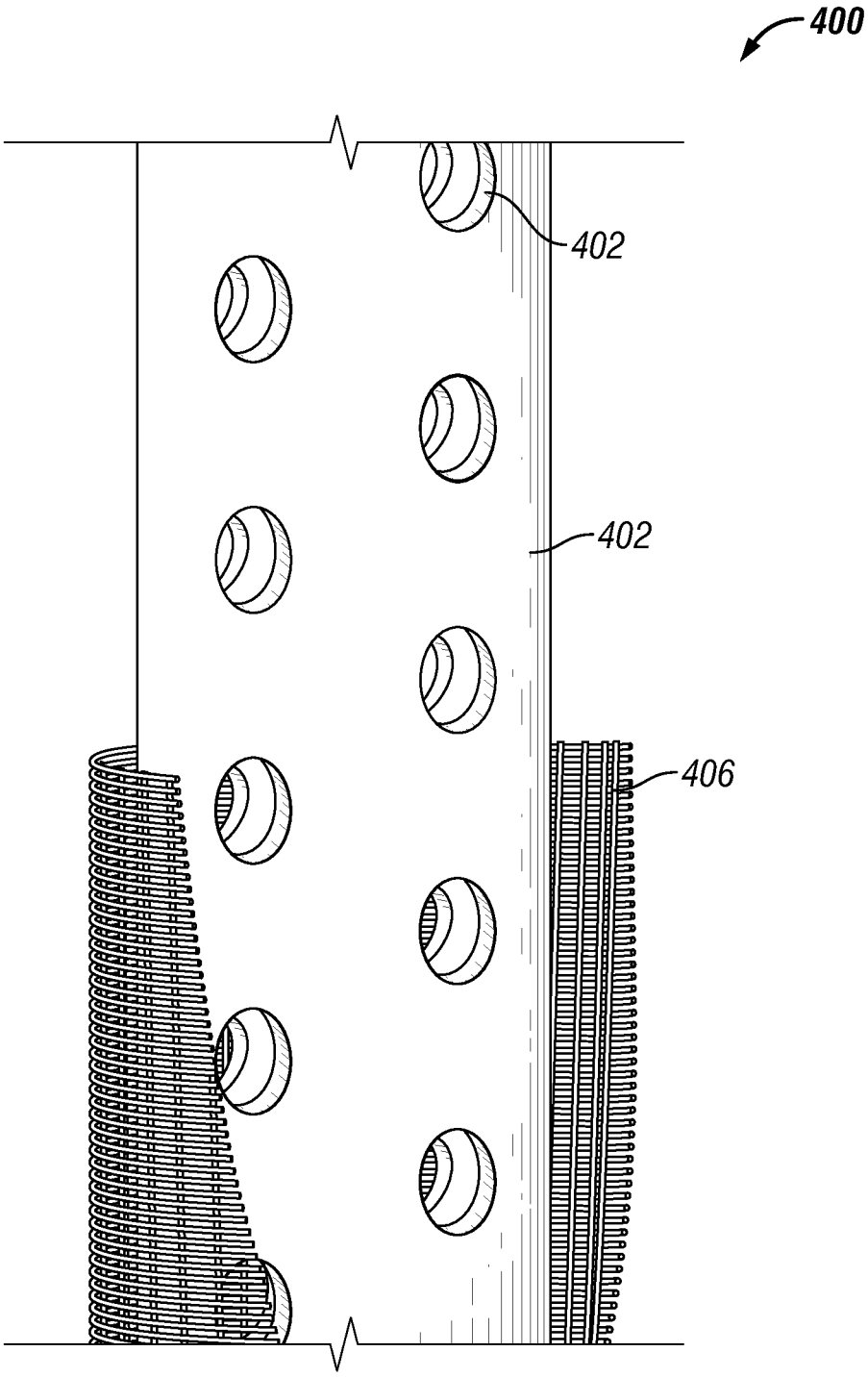
FIG. 4 illustrates a cutaway view of a sand control device, in accordance with example embodiments of the present disclosure.

FIG. 4 illustrates a cutaway view of a sand control device 400, in accordance with example embodiments of the present disclosure. The sand control device 400 of FIG. 4 is an example embodiment of the sand control device 102 of FIG. 1. In certain example embodiments, the sand control device 400 includes a base pipe 402. The base pipe 402 has a plurality of perforations 404 formed therein. The sand control device 400 also includes a screen medium 406 disposed around the base pipe 402. In certain example embodiments, the screen medium 406 acts as a screen or filter which prevents particulates of a certain size from entering the base pipe 402. In certain example embodiments, the screen medium 406 is a wire-wrapped screen. In another example embodiment, the screen medium 406 is a mesh. In certain example embodiments, the screen medium 406, the base pipe 402, or both is coated with a functionalized polymer coating.

Figure 5A:
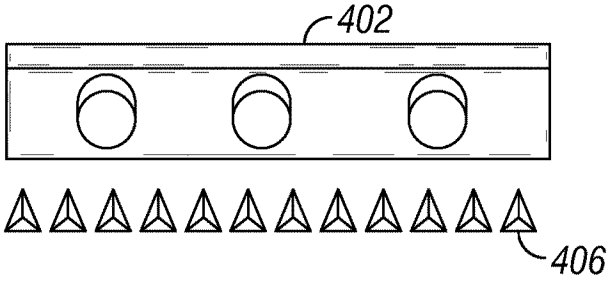
FIG. 5*a* illustrates an example sand control device with an uncoated base pipe and an uncoated screen medium, in accordance with example embodiments of the present disclosure.
Figure 5B:
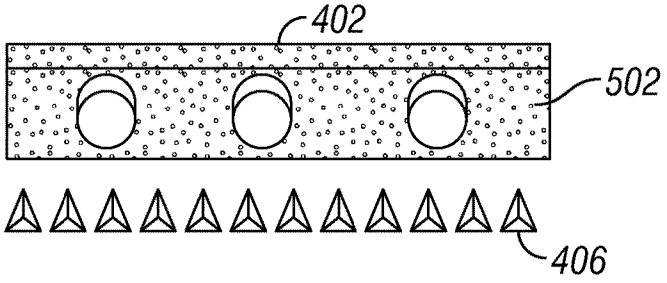
FIG. 5*b* illustrates an example sand control device with a base pipe having a functionalized polymer coating and an uncoated screen medium, in accordance with example embodiments of the present disclosure.
Figure 5C:
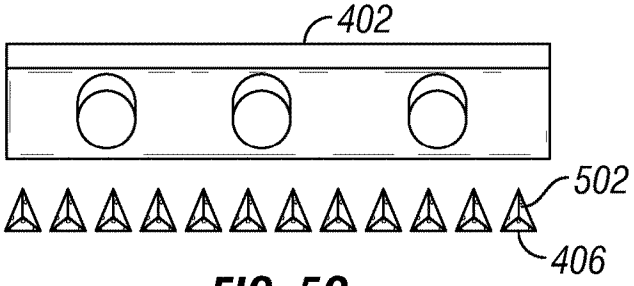
FIG. 5*c* illustrates an example sand control device with an uncoated base pipe and a screen medium having a functionalized polymer coating, in accordance with example embodiments of the present disclosure.
Figure 5D:
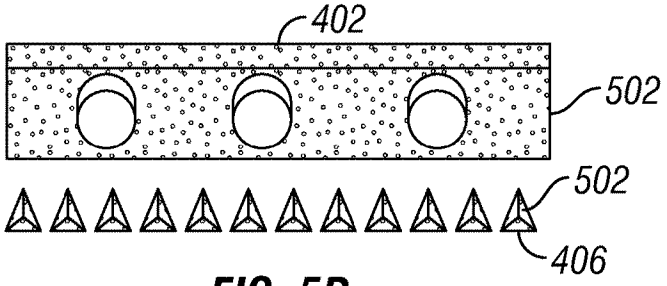
FIG. 5*d* illustrates an example of a sand control device with an base pipe having a functionalized polymer coating and a screen medium having a functionalized polymer coating, in accordance with example embodiments of the present disclosure.

FIGS. 5*a*-5*d* illustrate the various coating embodiments of the screen medium 406 and/or base pipe 402 of the sand control device 400, in which the functionalized coating is indicated by reference number 502. The functionalized coating may comprise polymers, copolymers, and other coatings with varying functionality. Specifically, FIG. 5*a* illustrates an example of an uncoated base pipe 402 and an uncoated screen medium 406. FIG. 5*b* illustrates an example embodiment including a base pipe 402 having a functionalized coating 502 and an uncoated screen medium 406, in accordance with example embodiments of the present disclosure. FIG. 5*c* illustrates an example embodiment including an uncoated base pipe 402 and a screen medium 406 having a functionalized coating 502, in accordance with example embodiments of the present disclosure. FIG. 5*d* illustrates an example embodiment including a base pipe 402 having a functionalized coating 502 and a screen medium 406 having a functionalized coating 502, in accordance with example embodiments of the present disclosure.

Referring to FIG. 4 and FIGS. 5*a*-5*d*, when corrosive particulates in the production fluid impact the functionalized polymer coating 502, small particle components of the coating material break off and enter the production stream and into the production tubing 106. Thus, presence of the functionalized polymer coating 502 in the recovered fluid indicates a level of erosion or erosive potential downhole. The functionalized polymer coating 502 can be a variety of different materials which include functional groups not expected to occur naturally in production fluids or a downhole environment, but that could be carried to the surface by the production stream. The functionalized polymer coating 502 is also detectable from the production fluid. One example of a type of functionalized polymer coating 502 used for this purpose is a fluorinated polymer. In certain other example embodiments, copolymers are used, in which a copolymer includes one functionality of a fluorinated organic material (for example) and an additional functionality as a second monomer. Thus, in such example embodiments, the detection of both functionalities in a sample of recovered fluid would indicate erosion in the zone whose sand control screen assembly was functionalized with that derivative. Examples of other functionalities that could be incorporated into polymers and/or copolymers include phosphorus, sulfur, bromide, fluorescent organic derivatives, mildly radioactive markers, and the like.

In certain example embodiments, an amount of erosion or expected erosion can be estimated from the amount of functionalized polymer (coatings) detected in the produced fluid at the surface. In certain example embodiments, the sand control device 400 can be divided into a plurality of zones, each zone corresponding to a respective reservoir region. In such example embodiments, each zone of the sand control device 400 is coated with a different functionalized polymer material. These different materials are detectably distinct from each other such that the relative amounts the different materials can be measured, which is indicative of the relative erosion or erosive potential between the respective reservoir regions. Thus, the zones and respective reservoir regions with relatively high amounts of erosive particulates can be better-known.

In certain example embodiments, the presence and amount of functionalized polymer in the produced fluids can be detected through various methods, including through a solid state measurement and a liquid state measurement. In solid state measurement methods, the produced solids (flaked off bits of the functionalized polymer coating 502) can be analyzed in their original form. One means of determining the presence of such materials is through the use of energy dispersive x-ray spectroscopy (EDS), which measures the relative amount of different functional atoms in a solid sample. Additionally, a scanning electron microscopy (SEM) analysis can also be performed on the sample to gauge the relative amounts of eroded coating and formation material. In certain example embodiments, the relative amounts of various functional materials can be found through analyzing aggregate samples of produced solids. In certain example embodiments, if other functionalities are incorporated into the functionalized polymer coating 502, such as fluorescent tags, radioactive tags, and the like, methods such as surface fluorescence spectroscopy, IR spectroscopy, gamma ray detection, and other methods of functional group analysis can be employed.

In liquid state measurement methods, the solid materials (flaked off bits of the functionalized polymer coating 502) are first treated to digest the solid materials and dissolve them in a carrier fluid. In certain example embodiments, this treatment includes heating the solid materials in an organic solvent, an aqueous solution or base, an acid, or the like. After the solid materials are dissolved into a liquid, the liquid solution containing the functionalized materials can be analyzed for the presence of the functionalized polymers. In certain example embodiments, inductively coupled plasma (ICP) spectroscopy, among other appropriate techniques, can be used to perform the analysis and determine the relative amount of the one or more functionalized polymers.

In certain example embodiments, the sand control device 102 includes one or more layers which are either fabricated from or coated with a material detectable within a production fluid. In some example embodiments, such a material can include a visible colorant which is distinct from the production fluid; a nanoparticle or nanocoating; a light detectable material; or a non-radioactive tracer. Although only a few examples of appropriate fabrication or coating materials are described herein for brevity, a wide variety of materials can be used which meet the requirements of the techniques disclosed in the present disclosure.

Figure 6:
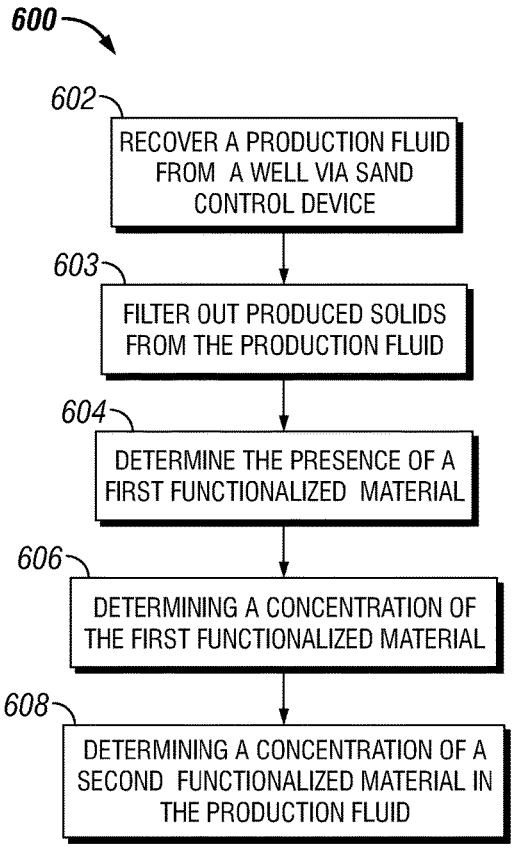
FIG. 6 illustrates a method of identifying erosive particulates in a reservoir via solid state analysis, in accordance with example embodiments of the present disclosure.

FIG. 6 illustrates a method 600 of identifying erosive particulates in a reservoir via solid state analysis, in accordance with example embodiments of the present disclosure. In certain example embodiments, the method 600 includes recovering a production fluid from a well via a sand control device (step 602). The sand control device includes a screen layer comprising at least a first functionalized material formed thereon or therein. The method also includes filtering out produced solids from the production fluid (step 603). In certain example embodiments, the method 600 includes a detector determining the presence of the first functionalized material from the produced solids (step 604). In certain example embodiments, the method 600 also includes a detector determining a concentration of the first functionalized material (step 606). In certain example embodiments, the concentration of the first functionalized material is determined through a detector that performs energy-dispersive x-ray spectroscopy. In certain example embodiments, the sand control device includes a second functionalized materials. In such example embodiments, the method 600 includes a detector determining a concentration of the second functionalized material (step 608). In certain alternative embodiments, the concentration of first, second, and additional functionalized materials are measured (step 608) concurrently.

Figure 7:
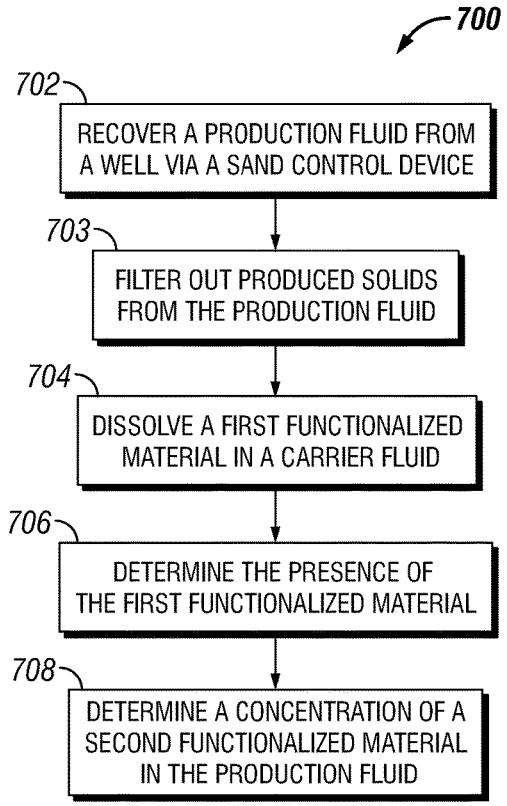
FIG. 7 illustrates a method of identifying erosive particulates in a reservoir via liquid state analysis, in accordance with example embodiments of the present disclosure.

FIG. 7 illustrates a method 700 of identifying erosive particulates in a reservoir via liquid state analysis, in accordance with example embodiments of the present disclosure. In certain example embodiments, the method 700 includes recovering a production fluid from a well through a sand control device (step 702). The sand control device includes a screen layer comprising at least a first functionalized material formed thereon or therein. In certain example embodiments, solid portions are obtained from the production fluid through a filtering process (steps 703). The solid portions are then digested or dissolved into a controlled diluent fluid. In certain other example embodiments, the method 700 includes dissolving the first functionalized material in a carrier fluid (step 704) and a detector determining the presence of the first functionalized material (step 706). In certain example embodiments, the presence of the first functionalized material is determined through a detector performing inductively coupled plasma spectroscopy. In certain example embodiments, the sand control device includes a second functionalized materials. In such example embodiments, the method 700 includes a detector determining a concentration of the second functionalized material (step 708). In certain example embodiments, the methods 600 and 700 include a subset of the steps described above. In certain example embodiments, the steps do not need to be performed in the order in which they were described above and measurement of various functionalized materials, for example, may happen concurrently. In certain example embodiments, the method includes additional steps not described herein.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sand control screen assembly, comprising:

a base pipe comprising a tubular surface and a plurality of perforations formed in the tubular surface;

a mesh layer disposed around the base pipe, wherein the mesh layer comprises a plurality of brittle, chemically functionalized fibers, wherein at least a portion of at least one of the plurality of brittle, chemically functionalized fibers breaks off from the mesh layer when impacted by one or more particulates, wherein the plurality of brittle, chemically functionalized fibers are chemically modified with a functional organosilane so as to be detectable in a production fluid, and wherein the functional organosilane is chemically modified with one or more of fluoride, bromide, sulfur, phosphorous, and fluorescent organic molecules; and a sand screen layer disposed around the mesh layer.

2. The sand control screen assembly of claim 1, wherein the plurality of brittle, chemically functionalized fibers include a plurality of functionalized silicate fibers.

3. The sand control screen assembly of claim 1, wherein the plurality of brittle, chemically functionalized fibers include a plurality of functionalized borosilicate fibers.

4. The sand control screen assembly of claim 1, wherein the mesh layer comprises a first portion and a second portion, wherein the first portion of the mesh layer comprises a first type of functionalized fiber and the second portion of the mesh layer comprises a second type of functionalized fiber, and wherein the first type of functionalized fiber is distinguishable from the second type of functionalized fiber.

5. The sand control screen assembly of claim 4, wherein the second portion of the mesh layer is disposed at a known depth of a well.

6. The sand control screen assembly of claim 1, wherein the plurality of brittle, chemically functionalized fibers is detectable within the production fluid through a solid-phase analysis method or a liquid-phase analysis method.

7. The sand control screen assembly of claim 6, wherein the solid-phase analysis method or liquid-phase analysis method include energy-dispersive x-ray spectroscopy or inductively coupled plasma mass spectroscopy.

8. A method of identifying erosive particulates in a reservoir, comprising:

recovering a production fluid from a well via a sand control device, the sand control device comprising a screen layer and a mesh layer disposed around a base pipe, wherein the mesh layer comprises a plurality of brittle, chemically functionalized fibers, wherein the plurality of brittle, chemically functionalized fibers are chemically modified with a functional organosilane, and wherein the functional organosilane is chemically modified with one or more of fluoride, bromide, sulfur, phosphorous, and fluorescent organic molecules, and wherein at least a portion of at least one of the plurality of brittle, chemically functionalized fibers breaks off from the mesh layer when impacted by one or more particulates;

determining, by a detector, the presence of the functional organosilane in the production fluid; and determining, by the detector, a concentration of the functional organosilane.

9. The method of claim 8, further comprising:

determining the presence of the functional organosilane through energy-dispersive x-ray spectroscopy.

10. The method of claim 8, further comprising:

dissolving the functional organosilane in a carrier fluid; and determining the presence of the functional organosilane through inductively coupled plasma spectroscopy.

11. The method of claim 8, further comprising:

determining a concentration of a second functionalized material, wherein the sand control device comprises the second functionalized material.

* * * * *